US011560675B2

(12) United States Patent
Buschmann et al.

(10) Patent No.: US 11,560,675 B2
(45) Date of Patent: Jan. 24, 2023

(54) ROAD FINISHER AND METHOD FOR DETERMINING THE LAYER THICKNESS OF A PAVING LAYER PRODUCED

(71) Applicant: JOSEPH VOEGELE AG, Ludwigshafen/Rhein (DE)

(72) Inventors: Martin Buschmann, Neustadt (DE); Tobias Noll, Roschbach (DE)

(73) Assignee: JOSEPH VOEGELE AG, Ludwigshafen/Rhein (DE)

( * ) Notice: Subject to any disclaimer, the term of this patent is extended or adjusted under 35 U.S.C. 154(b) by 198 days.

(21) Appl. No.: 15/931,808

(22) Filed: May 14, 2020

(65) Prior Publication Data

US 2020/0362522 A1 Nov. 19, 2020

(30) Foreign Application Priority Data

May 14, 2019 (EP) ..... 19174465

(51) Int. Cl.
*E01C 19/00* (2006.01)
*E01C 19/18* (2006.01)
*E01C 19/48* (2006.01)

(52) U.S. Cl.
CPC ..... *E01C 19/006* (2013.01); *E01C 19/185* (2013.01); *E01C 19/486* (2013.01); *E01C 19/002* (2013.01)

(58) Field of Classification Search
CPC .... E01C 19/006; E01C 19/185; E01C 19/486; E01C 19/002
See application file for complete search history.

(56) References Cited

U.S. PATENT DOCUMENTS 5,309,407 A 5/1994 Sehr et al.
5,393,167 A * 2/1995 Fujita ..... E01C 19/006 404/84.1
6,916,070 B2 * 7/2005 Sehr ..... E01C 19/006 299/1.5
7,172,363 B2 2/2007 Olson et al.
8,696,237 B2 4/2014 Hanfland et al.
8,702,344 B2 * 4/2014 Hanfland ..... G01B 21/08 404/84.1
9,033,611 B2 5/2015 Hanfland et al.
(Continued)

FOREIGN PATENT DOCUMENTS

CN 2823978 Y 10/2006
CN 102174792 A 9/2011
(Continued)

OTHER PUBLICATIONS

Japanese Office Action dated Aug. 31, 2021 (with English Machine Translation), Application No. 2020-083113, 6 Pages.
(Continued)

*Primary Examiner* — Abigail A Risic
(74) *Attorney, Agent, or Firm* — Brooks Kushman P.C.

(57) ABSTRACT

A road finisher is provided for producing a paving layer on a subgrade on which the road finisher is movable along a paving direction during a paving run. The road finisher is adapted to use distance measurements to the subgrade, which can be provided to a leveling system of the road finisher, equally as measured values for determining the thickness of a layer. A respective method for determining the layer thickness is provided.

14 Claims, 3 Drawing Sheets

(56) References Cited

U.S. PATENT DOCUMENTS

| | | | | |
|---|---|---|---|---|
| 9,988,733 | B2 | 6/2018 | Horn et al. | |
| 9,988,773 | B2 * | 6/2018 | Horn | E01C 19/22 |
| 10,227,738 | B2 | 3/2019 | Horn et al. | |
| 2012/0321384 | A1 * | 12/2012 | Hanfland | E01C 19/48 404/72 |
| 2012/0321386 | A1 * | 12/2012 | Hanfland | E01C 19/48 404/118 |
| 2015/0267361 | A1 * | 9/2015 | Horn | E01C 23/01 33/700 |
| 2017/0044726 | A1 | 2/2017 | Buschmann et al. | |
| 2019/0177930 | A1 * | 6/2019 | Ramb | E01C 19/4873 |
| 2020/0362522 | A1 * | 11/2020 | Buschmann | E01C 19/185 |
| 2021/0284075 | A1 * | 9/2021 | Steinhagen | F16B 2/10 |

FOREIGN PATENT DOCUMENTS

| | | | |
|---|---|---|---|
| CN | 102828457 | A | 12/2012 |
| CN | 102828458 | A | 12/2012 |
| CN | 102828459 | A | 12/2012 |
| CN | 102839592 | A | 12/2012 |
| CN | 106400662 | A | 2/2017 |
| CN | 106460350 | A | 2/2017 |
| CN | 109235204 | A | 1/2019 |
| CN | 212983528 | U | 4/2021 |
| DE | 10 2016 225 502 | A1 | 6/2018 |
| DE | 10 2016 225 502 | B4 | 1/2019 |
| EP | 0 542 297 | A1 | 5/1993 |
| EP | 2 535 456 | A1 | 12/2012 |
| EP | 2 535 457 | A1 | 12/2012 |
| EP | 2 535 458 | A1 | 12/2012 |
| EP | 2 921 588 | A1 | 9/2015 |
| EP | 3 130 939 | A1 | 2/2017 |
| EP | 3 228 981 | B1 | 10/2018 |
| JP | H01-271504 | A | 10/1989 |
| JP | H 1271504 | A | 10/1989 |
| JP | H 4272303 | A | 9/1992 |
| JP | H 7127017 | A | 5/1995 |
| JP | 20132278 | A | 1/2013 |
| WO | 02/46533 | A1 | 6/2002 |

OTHER PUBLICATIONS

Chinese First Office Action dated Jul. 9, 2021 (with English Machine Translation), Application No. 202010406498.7, 19 Pages.

European Search Report dated Nov. 29, 2019, Application No. 19174465.5-1002, Applicant Joseph Voegele AG, 10 Pages.

Ndian First Examination Report dated Nov. 30, 2021, Application No. 202014019027, 6 Pages.

European Notice of Opposition dated Jan. 28, 2022 (with English Machine Translation), Application No. / Patent No. 19174465.5-1002 / 3739122, Applicant Joseph Voegele AG, 53 Pages.

E1—Voegle-RoadNews-6, Joseph Voegele AG, Jun. 2009 (with Partial English Translation—Cover Page & pp. 16-21), 18 Total Pages.

E4b—CN 2823978 Y—Machine Translation Abstract & Description, 7 Pages.

E5b—German Translation of JPH01-271504A, 15 Pages.

Chinese Office Action (with English Machine Translation), dated Oct. 8, 2022, Application No. 202010406498.7, 13 Pages.

* cited by examiner

ROAD FINISHER AND METHOD FOR DETERMINING THE LAYER THICKNESS OF A PAVING LAYER PRODUCED

CROSS-REFERENCE TO RELATED APPLICATIONS

This application claims foreign priority benefits under 35 U.S.C. § 119(a)-(d) to European patent application number EP 19 171465.5, filed May 14, 2019, which is incorporated by reference in its entirety.

TECHNICAL FIELD

The disclosure refers to a road finisher for determining the layer thickness of paving layer and to a method for determining a layer thickness by means of a road finisher.

BACKGROUND

In practice, road finishers are used for the construction of traffic routes and surfaces. Road finishers are capable of receiving material, e.g., from a truck, and paving it according to the requirements of road construction.

Typically, so-called leveling systems are used on road finishers to control the evenness of the paved layer. These systems usually control the height of the paving screed installed on the road finisher on the basis of a scanned reference. The reference used is, for instance, the subgrade on which the road finisher is moving, a gutter plate, a curbstone or a reference wire stretched along the paving section. Level sensors are used for scanning the reference. So-called multiplex systems, which use a plurality of sensors to scan the relative level of the subgrade and the layer being paved, are gaining in importance. In principle, a reference value for controlling the paving screed's height is then calculated by averaging. This can be done with two separate systems for the left and right side of the paving screed.

One of the main paving targets is the layer thickness produced. Maintaining a predetermined layer thickness is not only a quality criterion, but also has a significant influence on the economic efficiency of the construction project. If the contractor falls short of the required layer thickness, this can result in financial deductions in retrospect. If, on the other hand, the layer thickness is exceeded, this leads to increased asphalt consumption and thus to significantly higher costs. Control of the layer thickness is therefore essential for paving. The road finisher operator must therefore check at regular intervals whether the road finisher is paving the required layer thickness.

Even today, the layer thickness is still checked by manually piercing gauges or by means of a folding rule. The disadvantage of this approach is that the layer thickness is only determined at certain points. In addition, the accuracy of manual measurements is determined by the skill of the operator. The values determined in this way are often relatively inaccurate and can of course not be digitally processed for automation or documentation purposes.

As a further measuring method for determining the layer thickness paved, the measurement by means of magnetic field induction is known. Here, metal reflector foils are applied to the subgrade prior to the actual paving of the road and can be measured by a measuring device to determine the layer thickness after it has been paved. This enables the layer thickness applied to the reflector foil to be measured by the measuring device after paving. However, this method of determining the layer thickness is not available in real time. In addition, the pre-applied reflector foils can weaken the layer compound. Efforts to automate the process are known, but have not been able to establish themselves in practice due to the complicated structure. This may also be due to the fact that the layer thickness measurement can only be carried out at certain points, as in the case of the previously described practice using manual measurement.

There are also solutions for layer thickness determination in use, which are so-called "hang-on systems", i.e., attachment modules specially designed for mounting on the road finisher, which, without being integrated into the machine system of the road finisher, have to be mounted separately on the road finisher in a special way for layer thickness determination and determine the layer thickness independently. The disadvantage of such "hang-on systems" is that their use makes the structure of the road finisher more complicated, because sensor hardware components in particular are added to the road finisher. In addition, the separate transport and attachment of such additional modules and their independent mode of operation requires additional transport, storage and attachment equipment as well as trained operating personnel, which makes the use of the road finisher at the construction site more complicated and increases the manufacturing costs. Another problem with such "hang-on systems" is that there may be differences between the real layer thickness and the detected layer thickness if the subgrade to be built over is uneven or if the paving screed's angle of attack changes.

SUMMARY

Against the background of the state of the art as described above, an object of the disclosure is based on equipping a road finisher with a layer thickness detection system which can be used without any problems in terms of design and technology, in particular without major transport and construction costs, and which can also be implemented on the road finisher without major production costs. Furthermore, it is an object of the disclosure to provide a method by which the layer thickness of a paving layer produced can be measured on a road finisher.

The disclosure refers to a road finisher for producing a paving layer on a subgrade on which the road finisher moves along a paving direction during a paving run. The road finisher according to the disclosure comprises a height-adjustable paving screed for producing the paving layer and a leveling system configured to control a height of the paving screed, in particular to compensate for unevenness of the subgrade. The leveling system comprises a first measuring device comprising at least a first sensor unit configured to contactlessly measure at least a first distance to a surface of the subgrade during the paving run. The first measuring device further comprises at least a second sensor unit configured to contactlessly measure at least a second distance to a surface of the paving layer produced on the subgrade during the paving run.

The road finisher according to the disclosure is further designed to determine a reference level based on the first and second measured distance, on the basis of which a leveling actual value can be provided to the leveling system for controlling the height of the paving screed. In particular, the leveling actual value is a control variable which is termed on the basis of a sampled difference in comparison with a targeted, in particular averaged reference level, and can be used for automatic adjustment of the paving screed's height, whereby both long and short distance sampled unevenness in the subgrade can be compensated for during paving.

According to the disclosure, the road finisher is configured to further determine a layer thickness of the paving layer produced on the subgrade based on the first distance measured by the first sensor unit and the second distance measured by the second sensor unit. This means that the layer thickness measuring function on the road finisher according to the disclosure is integrated in the leveling system working on the road finisher. In addition to its actual leveling function, the leveling system thus also provides a function for determining the layer thickness, as an integral part of the system, so to speak.

In this case, the sensors of the road finisher in accordance with the disclosure are at least partially used to determine the layer thickness of the paving layer produced by the road finisher. In other words, the road finisher according to the disclosure uses the same sensor units to forming the reference level for the leveling system and to measure the layer thickness. This means that the sensor unit of the leveling system on the road finisher is also used for measuring the layer thickness. These jointly used sensor units are identical both in terms of their functional mode of operation and their location on the road finisher.

As the distance measurements to the respective subgrade detected by the two sensor units during paving operation are used equally for both the leveling function and the layer thickness detection function, the metrological setup on the road finisher is simplified on the one hand, and the road finisher's production costs are reduced on the other. In addition, the volume of data associated with the distance measurements, which is used as a common database for the leveling and layer thickness measurement function, can be reduced, thus minimizing the overall computing effort required for the respective functions.

In addition, the operating personnel trained in the use of the leveling system's sensors on the job site can handle the layer thickness measuring function essentially without any additional training effort. This is particularly due to the fact that the respective sensor units for the leveling system and for layer thickness determination are identical with regard to their mode of operation and in view of their design, installation and installation location.

The road finisher according to the disclosure therefore forms an integral leveling and layer thickness measuring system. In contrast to the state of the art, the leveling system and the layer thickness measuring function no longer use separate sensor units on the road finisher which are designed for the respective purpose, but use the same sensor units for the respective leveling and layer thickness measuring function.

Preferably, the layer thickness can be determined continuously during the paving run. Alternatively, the layer thickness measurement could be carried out at intervals.

The road finisher is preferably designed to determine the layer thickness solely by means of the hardware components used on it for the leveling system. This logically avoids the need for additional attachments on the road finisher for determining the layer thickness. The measuring device used for both the leveling and the layer thickness measuring functions has a component-reduced integral design and forms a multifunctional module on the road finisher, which is preferably attached to the road finisher in a detachable manner.

One variant provides that the distances measured by the sensor units of the measuring device can be used both as a basis for automatic leveling of the paving screed and for a layer thickness measuring function. This means that the distance measurements detected are used likewise preferably in parallel steps as the basis for calculation for the automatic leveling and the layer thickness determination. Due to the common basis of measured values, both the automatic leveling and the layer thickness measurement can be carried out with little design and measurement effort.

It is advantageous if the automatic leveling on the road finisher is addressable separately from or together with the layer thickness measuring function. This enables extended operation of the road finisher. In this way, the layer thickness measurement could be run separately, while the leveling of the paving screed is controlled manually by an operator, for instance at an external control station of the road finisher, on the basis of the scanned reference level that may be displayed at the external control station.

Preferably, the road finisher provides for a common control device for the leveling system and the determination of the layer thickness, which is installed integrally on the road finisher. In this case, the control device forms a central calculation unit for the leveling system and the layer thickness measuring function integrally provided on the leveling system. This allows a further reduction of the electronics installed on the road finisher. As an option, the control device can also be equipped with the respective calculation components enabling the leveling function and/or layer thickness measuring unction to be carried out independently on both sides of the paving screed.

According to an advantageous variant of the disclosure, the control device is configured to adjust a position of leveling cylinders attached to the paving screed at front pulling points for varying the layer thickness, based on the actual leveling value. Depending, on the evenness of the existing subgrade, the leveling cylinders can be used to compensate for unevenness so that the paving screed in floating mode does not reproduce unevenness in the subgrade but lays a planar paving layer.

The first measuring device preferably has a supporting structure for the first and second sensor units extending along the paving direction, on which the first sensor unit is positioned in front of the paving screed and the second sensor unit behind the paving screed in the paving direction. The supporting structure may consist of an assembly of a plurality of beams extending in the paving direction on which the respective sensor units are mounted. The supporting structure can be straight or stepped when viewed in the vertical projection plane.

Preferably, the first measuring device thither comprises a third and a fourth sensor unit for measuring respective distances to the surface of the subgrade, the third and fourth sensor unit being positioned in front of the paving screed on the supporting structure in the paving direction.

It is appropriate if the first, second, third and fourth sensor units are positioned on the supporting structure of the first measuring device in the paving direction at a multiple of a predetermined distance from each other. In use, the sensor units positioned in front of the paving screed could be equally spaced. The sensor unit positioned behind the paving screed could be spaced by twice the distance between the sensor units positioned in front of it and the sensor unit positioned immediately in front of it in front of the paving screed. For adjusting the distances between the sensor units, markings could be provided on the supporting, structure as a mounting, aid.

A preferred variant provides that the road finisher comprises at last one distance measuring means for layer thickness determination, said distance measuring means having a satellite-based and a mechanical distance measuring unit or comprises at least one optical distance measuring unit. For example, the aforementioned combined distance measuring means consists of a GPS-based and a hodometer measuring unit of the road finisher's drive, so that high measuring accuracies can be achieved by means of the functional combination of these sensor measuring systems. It is conceivable that the satellite-based distance measuring unit has a GPS system, in particular a GNSS, DGPS, DGNSS and/or RTK unit.

The distance measuring means can be used to measure the distance to the subgrade and to the surface of the paving layer paved at the same location, i.e., at a predetermined geographical position, in order to determine the thickness of the layer precisely from these distance measurements, for example by subtraction. In this case, a set of distance measurements can be offset against each other to determine the layer thickness, whereby the offset distance measurements at a predetermined point on the paving layer are recorded with a time delay with regard to the distance of the sensor units to each other. The offset distance measurements thus consist of a distance measurement to the subgrade by means of at least one of the sensor units positioned in front of the paving screed and of a distance measurement to the surface of the paving layer produced by means of the sensor unit positioned behind the paving screed at exactly the same geographical location with a time delay if the latter reaches the point at which the layer thickness is to be measured during the paving run.

In other words, the distances measured behind the paving screed to the surface of the paving layer produced can be offset against the layer thickness by distance measurements taken at the same location by at least one of the sensor units positioned in front of the paving screed before (i.e., before the road finisher has moved the distance between the adjacent sensor units). Linking of respective distance measurements taken at the same location during, the paving run before and behind the paving screed is achieved by means of the distance measuring means.

In addition to the distance measuring means, a speed sensor can be used on the road finisher, especially on its drive, to determine the time delay at which the distance measurements are carried out at the same geographical point.

Based on the detected layer thickness and the distance to be paved, which can be measured by the distance measuring means, other paving related parameters can be determined, especially in combination with other operating settings on the road finisher, such as a set paving width. It would be conceivable that the distance measurement could be used in conjunction with layer thickness determination and paving screed width measurement to determine the volume of material paved. In addition, the current or cumulated mass of the paved material could be determined on the basis of a predetermined asphalt density. Furthermore, plausibility checks could be carried out with regard to the order specifications to be adhered to, especially based on the detected layer thickness and the detected distance measurement data.

A variant of the disclosure provides that the sensor units each have an ultrasonic multi-sensor comprising a plurality of sensor cells arranged next to one another, in particular in a line, each of which is designed to carry out distance measurements to the subgrade or paving layer. The sensor units are thus available as wide-range sensors. This means that predetermined, desired measuring ranges, for example within a measuring width of approximately 30 cm, can be detected by means of the respective sensor units, so that the respective distance measurements of the sensor units are more reliable for the leveling system and the layer thickness measuring function.

Preferably, the road finisher is equipped with a filter function for automatic leveling and/or for determining the layer thickness so that the paving screed can be adjusted in height in an optimum manner and/or so that obvious measuring, errors can be compensated for when determining the layer thickness. To this end, it may be provided that the road finisher is designed to take into account the distance measurements detected by the sensor units by means of the respective sensor cells formed on them, which are tolerant with regard to a nominal distance measurement value that can be variably adjusted for the respective sensor units, when leveling the paving screed and/or determining the layer thickness. Other distance measurements deviating from a predetermined tolerance range may be disregarded when leveling the paving screed and/or determining the layer thickness. Thus, it is possible to ignore those measured values which represent larger deviations from the tolerance range, i.e., not to include them when leveling the paving screed and/or determining the layer thickness. This allows to filter out short unevenness of the subgrade detected by the respective sensor units, but also, for instance, tools lying around on the subgrade and detected by the sensor units, when scanning the reference level.

One embodiment of the disclosure provides that the currently determined layer thickness or a layer thickness averaged over a period of time can be provided in the leveling system for controlling the height of the paving screed as a further actual value for leveling. This means that the current or averaged layer thickness can be taken into account when controlling and/or regulating the evenness of the paving layer, which allows, in particular, not only the level paving but also the paving in the range of the optimum layer thickness to be carried out automatically.

Preferably, the leveling system comprises a second measuring device, the first measuring device being located on one side of the road finisher in the paving direction and the second measuring device being located on an opposite side of the road finisher in the paving direction. The two measuring devices may be of identical design and function. This enables a leveling and layer thickness determination function provided on both sides of the road finisher in the paving direction.

In particular, leveling of the paving screed can be carried out separately using the leveling cylinders of the road finisher, i.e., on the left and right side of the road finisher. The first measuring device on the left side of the road finisher can be used to control the leveling cylinder mounted on the left side of the road finisher, and the second measuring device on the right side of the road finisher can be used to control the leveling cylinder mounted on the right side of the road finisher.

Preferably, the leveling system is functionally connected to a memory unit on Which the layer thickness readings recorded during the paving run can be stored for documentation purposes. One variant provides for the recorded layer thickness to be displayed visually at an external control station of the road finisher by means of a display unit attached to it. The layer thickness can then be monitored by the operator during operation of the road finisher, i.e., during the paving run, who can adjust the paving screed's height in case of a difference between the measured layer thickness and the predetermined layer thickness. When the automatic leveling is activated, the leveling cylinders automatically control the height of the paving screed.

Preferably, the road finisher includes a transmission unit by means of which the detected layer thickness values can be transmitted to an external device, for example to a supply station for paving material.

The disclosure also relates to a method of operating a road finisher. In the method according to the disclosure, the same sensor units installed on the road finisher are used locally both for a leveling system function which can be addressed on the road finisher for leveling uneven subgrade and for a layer thickness measuring function which can also be addressed on the road finisher for determining a layer thickness of a paving layer produced by means of the road finisher. The leveling system used on the road finisher thus uses the same sensor units as the layer thickness measuring function. This enables the electronics installed on the road finisher to be reduced. No additional transport and set-up measures on the road finisher are required for layer thickness measurement.

The method in accordance with the disclosure uses common sensor units for the leveling system provided on the road paver as well as for the layer thickness determined by the road paver, whereby the road paver can be put into operation faster on the construction site due to the reduced number of components to be mounted on it.

BRIEF DESCRIPTION OF THE DRAWINGS

Embodiments of the disclosure are explained in more detail with reference to the following Figures.

Technical features are marked with the same reference numerals throughout the Figures.

DETAILED DESCRIPTION

Figure 1:
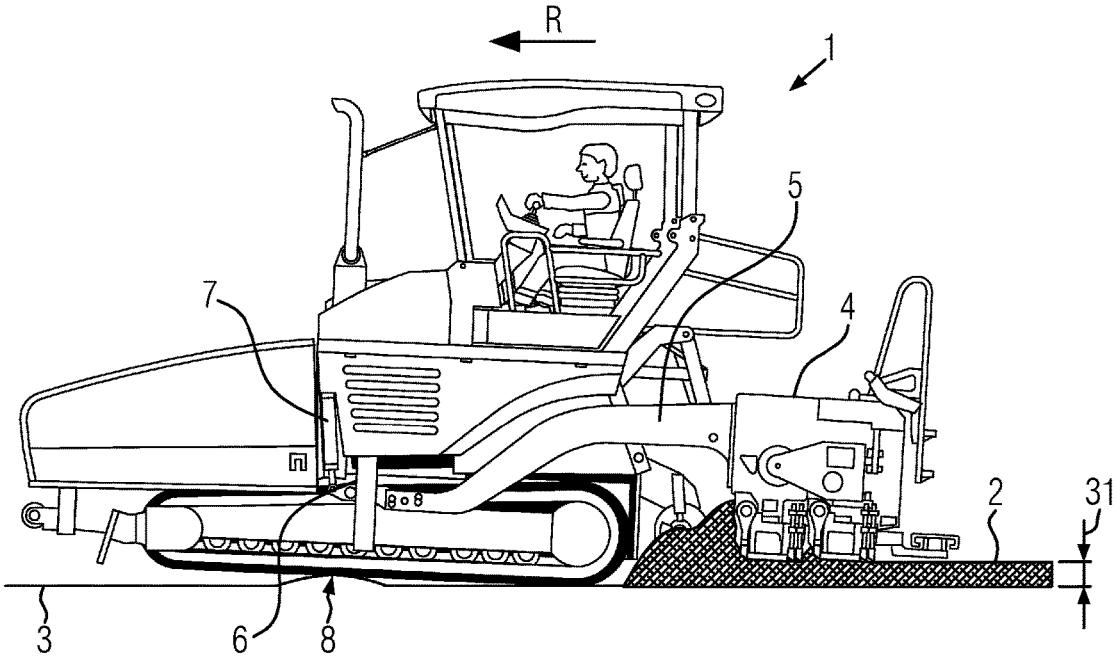
FIG. 1 shows a road finisher for producing a paving layer on a subgrade.

FIG. 1 shows a road finisher 1 producing a paving layer 2 on a subgrade 3 on which the road finisher 1 is moving along a paving direction R during a paving run. The road finisher 1 is equipped with a height-adjustable paving screed 4 for (pre)compacting the paving layer 2. The paving screed 4 is attached to a screed bar 5, which is connected to a leveling cylinder 7 of the road finisher 1 at a front traction point 6. The screed bar 5 serves as a lever to convert a variation of a leveling cylinder position into a variation of an angle of attack of the paving screed 4, in particular to compensate for unevenness 8 in the subgrade 3.

Figure 2:
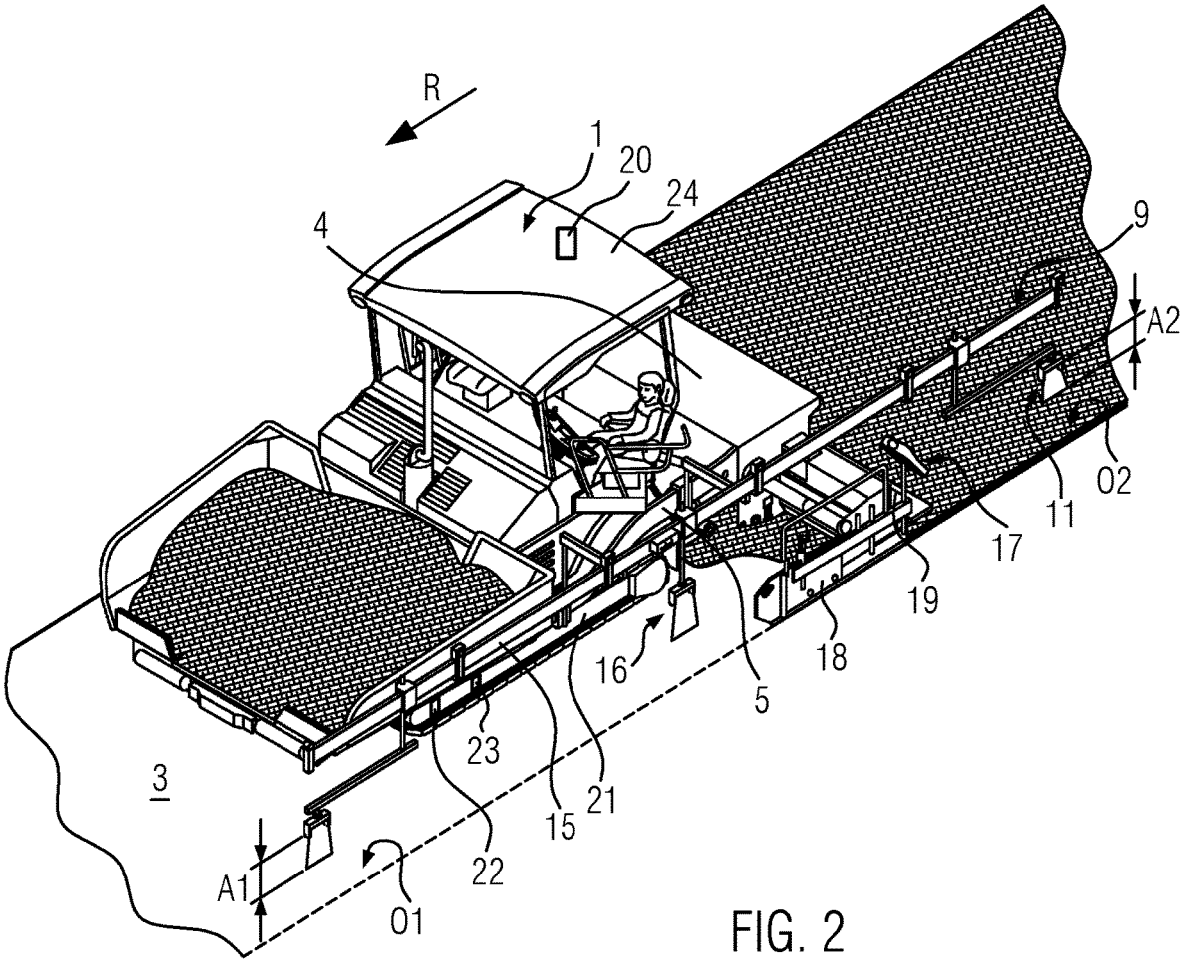
FIG. 2 shows a road finisher with a laterally arranged, elongate measuring device for establishing a virtual reference level for an automatic leveling.

FIG. 2 shows the road finisher 1 during the paving run. In FIG. 2, the paving screed 4 is configured as a telescoping screed. A first measuring device 9 is located at the screed bar 5. The measuring device 9 comprises a first sensor unit 10, which is configured to contactlessly measure a first distance A1 to a surface O1 of the subgrade 3, for example by means of ultrasound, during the paving run. The measuring device 9 also has a second sensor unit 11 which is configured to contactlessly measure a second distance A2 to a surface O2 of the paving layer 2 produced on the subgrade 3, for example by means of ultrasound, during the paving run.

Using the first sensor unit 10 and the second sensor unit 11, the relative height of the subgrade 3 and the paved paving layer 2 is scanned in FIG. 2 in order to determine a reference level 12 (see FIG. 4) from these measurement results. Based on this, a leveling actual value 13*a*, 13*b* is generated as a control variable which can be used in the leveling system 14 to control the level of the paving screed 4 (see FIG. 5).

According to FIG. 2, the measuring device 9 comprises a supporting structure 15 which extends over several meters in the paving direction R to the side of the road finisher 1. The first sensor unit 10 is located on the supporting structure 15 in front of the paving screed 4 in paving direction R. The second sensor unit 11 is attached to the supporting structure 15 behind the paving screed 4 in paving direction R. FIG. 2 also shows that a further, third sensor unit 16 is mounted on the supporting structure 15 at a short distance in front of the paving screed 4 in paving direction R.

FIG. 2 also shows an external control station 17 attached to the paving screed 4 by means of a sideshift 18. On the external control station 17, distance measurements of the respective sensor units 10, 11, 16 (including the fourth sensor unit 25 shown in FIG. 3) can be monitored and controlled by an input/display unit 19 provided on the external control station. In case the reference level 12 based on the height measurements does not correspond to a target reference level, this can be displayed on the input/display unit 19. An operator can then use the input/display unit 19 to manually change a height of the paving screed 4 on the left and/or right side of the road finisher, for instance, to compensate for detected unevenness 8 in the subgrade. An automatic leveling system can be used as a supplement or alternative to control the height of the paving screed 4.

FIG. 2 also shows that road finisher 1 has a satellite-based distance measuring unit 20 (e.g., a GNSS, DGPS, DGNSS and/or RTK unit) on a roof structure 24. The satellite-based distance measuring unit 20 can be part of a satellite-based navigation system of the road finisher 1 and is adapted to carry out a GPS measurement for determining the position of the road finisher 1. In addition, the road finisher 1 shown in FIG. 2 has a mechanical distance measuring unit 22 mounted on the drive 21 of the road finisher 1. The mechanical distance measuring unit 22 is configured, for example, as a podometer device to determine a distance travelled by the road finisher 1 during, the paving run. On the road finisher 1 of FIG. 2, the satellite-based distance measuring unit 20 and the mechanical distance measuring unit 22 are functionally linked to each other in order to provide, as an integral distance measuring means, a highly accurate measurement of the distance travelled by the road finisher 1 during the paving run, in particular for the purpose of determining the thickness of the paving layers.

Alternatively, the distance measuring means formed by a combination of the satellite-based and mechanical distance measuring units 20, 22 could also consist of an optical distance measuring unit 23, which is arranged in particular on a chassis of the road finisher 1.

Figure 3:
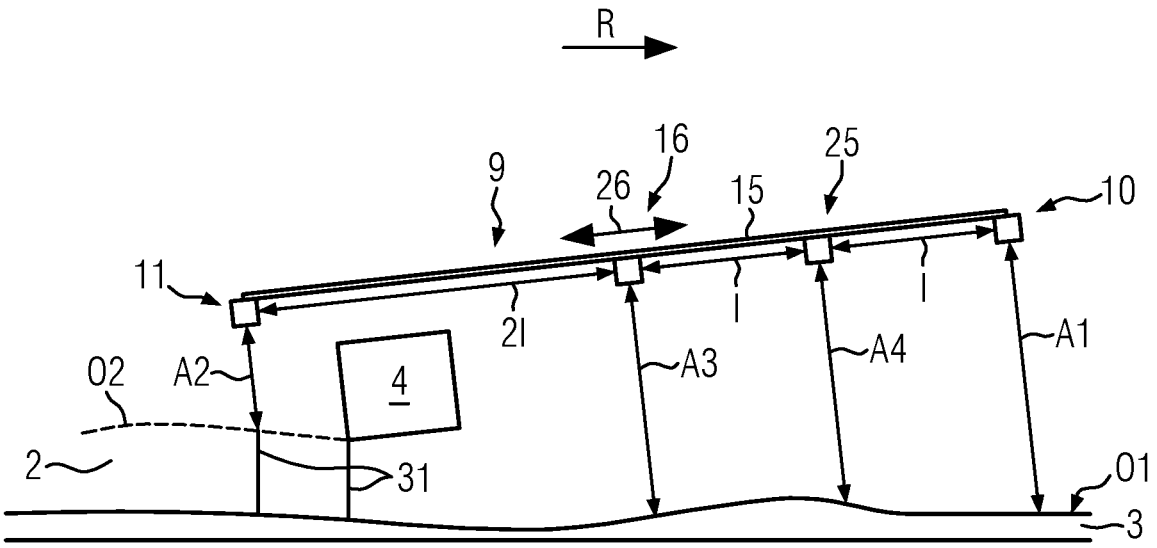
FIG. 3 shows a schematic view of a measuring device according to FIG. 2 with four sensor units.

FIG. 3 shows a schematic view of measuring device 9 with a total of four sensor units 10, 11, 16, 25 arranged thereon. In paving direction R, the second sensor unit 11 is arranged behind the paving screed 4 on the supporting structure 15 of the measuring device 9 to measure the second distance A2 to the surface O2 of the paved paving layer 2. In paving, direction R, three sensor units 10, 16, 25 are positioned in front of the paving screed 4 to measure the height to the subgrade 3. The first sensor unit 10 is positioned at the very front of the supporting structure 15 of the measuring device 9. The third sensor unit 16 and a further, fourth sensor unit 25 are positioned behind it in paving direction R of the paving screed in order to measure a distance A3, A4 to the surface O1 of the subgrade 3. The frontmost, first sensor unit 10 is distanced by a distance 1 from the fourth sensor unit 25 positioned behind it in the paving direction R. There is also a distance 1 between the fourth sensor unit 25 and the third sensor unit 16 positioned further behind it on the supporting structure 15 in the paving direction R.

Furthermore, FIG. 3 shows that the second sensor unit 11, which is positioned at the end of the supporting structure 15, is positioned at twice the distance 1 from the third sensor unit 16, which is positioned at the front in the paving direction R. The distance between the respective sensor units 10, 11, 16, 25 on the supporting structure 15 of measuring device 9 can be variably adjusted, which is shown schematically by means of an arrow 26 in the area of the third sensor unit 16.

Figure 4:
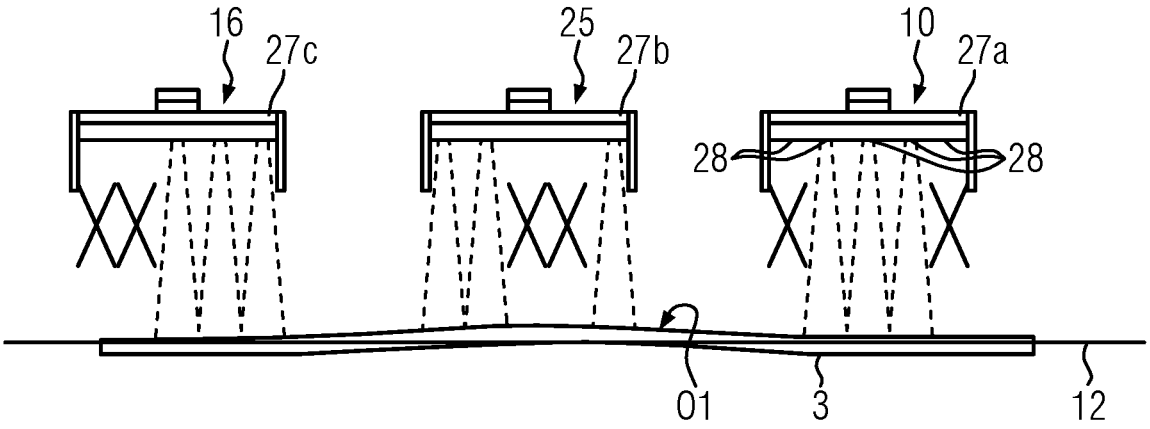
FIG. 4 shows a schematic view of a measuring principle of the sensor units shown in FIG. 3 directed in the paving direction in front of the paving screed towards the subgrade.

FIG. 4 shows a schematic view of the measuring principle of the sensor units 10, 16, 25 used on the measuring device 9. FIG. 4 shows an example of the sensor units 10, 16 and 25 positioned on the supporting structure 15 of the measuring device 9 in the paving direction R in front of the paving screed 4.

The first, third and fourth sensor units 10, 16, 25 (as well as the second sensor unit 11 from FIG. 3 not shown in FIG. 4) are each designed as ultrasonic multi-sensor 27*a*, 27*b*, 27*c* according to FIG. 4. The respective ultrasonic multi-sensors 27*a*, 27*b*, 27*c* have a plurality of sensor cells 28 arranged next to each other. In FIG. 4, the respective ultrasonic multi-sensors 27*a*, 27*b*, 27*c* each have five sensor cells 28 arranged in a row. The respective distances to the subgrade 3, measured by means of the sensor cells 28, can be used to determine the virtual reference level 12 shown FIG. 4.

FIG. 4 shows schematically that only three height measurements detected at the respective ultrasonic multi-sensors 27*a*, 27*b*, 27*c* are used to form the reference level 12. The measured values detected at the respective sensor units 10, 16, 25, which represent the largest deviations from a stored or calculated reference, are ignored and are not included in the calculation of the reference level. The reference level 12 can be established, for example, by averaging the measured values detected and taken into account by the respective sensor units 10, 16, 25.

Figure 5:
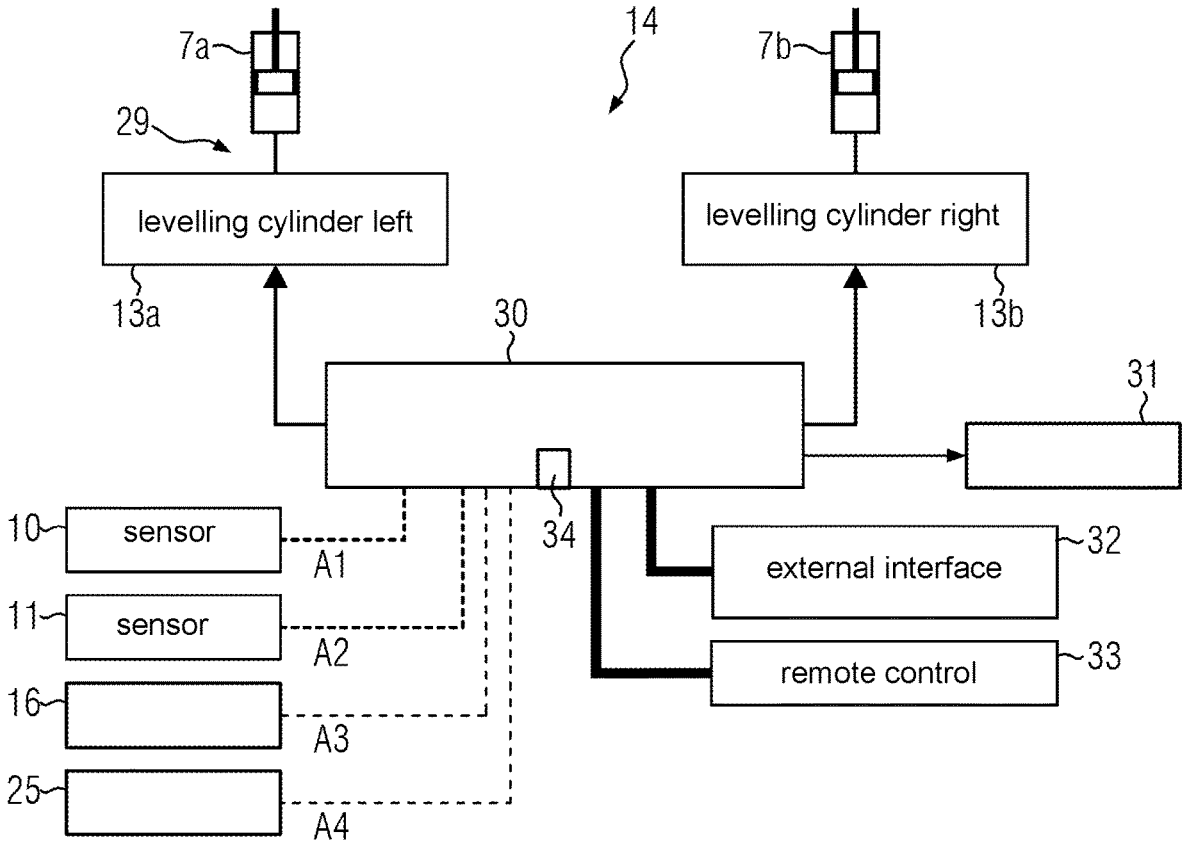
FIG. 5 shows schematic view of the leveling system used on the road finisher with integrated layer thickness measuring function.

Based on the detected reference level 12, the leveling system 14 shown in FIG. 5 can carry out an automatic leveling operation 29 on respective leveling cylinders 7*a*, 7*b* attached to the left and right of the road finisher 1 to automatically control a level of the paving screed 4, especially for compensating for unevenness 8 in the subgrade 3.

The leveling system 14 shown in FIG. 5 is installed integrally on the road finisher 1. The leveling system 14 comprises a central control unit 30 which is continuously fed with distance measurements from the respective sensor units 10, 11, 16, 25. The control device 30 is configured to determine the reference level 12 and, based on this, to generate actual leveling values 13*a*, 13*b* for the respective leveling cylinders 7*a*, 7*b* to control them in order to vary a position of the leveling cylinders 7*a*, 7*b*. Furthermore, the central control device 30 is configured to determine a layer thickness 31 (see also FIGS. 1 and 3) based on the respective detected distances A1, A2, A3, A4 of the sensor units 10, 11, 16, 26.

FIG. 5 shows that the distance measurements A1, A2, A3, A4 detected by the sensor units 10, 11, 16, 25 for the leveling system 14 for producing the reference level 12 are also used to determine the layer thickness 31 of the produced paving layer 2.

The leveling system 14 in FIG. 5 also has a transmission device 32 by means of which the calculated layer thickness values can be transmitted to an external device (not shown).

Furthermore, FIG. 5 shows that the leveling system 14 can be controlled by means of a functionally connected control 33. The control 33 can, for example, be an integral part of the external control station 17, especially the input unit 19 positioned there. Finally, FIG. 5 shows that the leveling system 14 has a memory unit 34 which, according to FIG. 5, can be designed, for example, as an integral part of the control unit 30, in particular to store detected layer thickness measurements for documentation purposes.

What is claimed is:

1. A road finisher for producing a paving layer on a subgrade on which the road finisher is movable along a paving direction during a paving run, the road finisher comprising a height-adjustable paving screed for producing the paving layer and a leveling system configured to control a height of the paving screed, in order to compensate for unevenness of the subgrade, wherein the leveling system comprises a first measuring device comprising at least a first sensor unit configured to contactlessly measure at least a first distance to a surface of the subgrade during the paving run and at least one second sensor unit configured to contactlessly measure at least a second distance to a surface of the paving layer produced on the subgrade during the paving run, wherein the road finisher is configured to determine a reference level based on the first and second distances, on the basis of which a leveling actual value can be provided to the leveling system for controlling the height of the paving screed, and wherein the road finisher is configured to further determine a layer thickness of the paving layer produced on the subgrade based on the first distance measured by means of the first sensor unit and on the second distance measured by means of the second sensor unit.

2. The road finisher according to claim 1, wherein the road finisher is configured to determine the layer thickness solely by means of hardware components used on the road finisher for the leveling system.

3. The road finisher according to claim 1, wherein the distances measured by means of the sensor units of the measuring device can be used both as a basis for an automatic leveling of the paving screed and for a layer thickness measuring function.

4. The road finisher according to claim 3, wherein the automatic leveling can be addressed on the road finisher separately from or together with the layer thickness measuring function.

5. The road finisher according to claim 1 further comprising a common control device for the leveling system and the determination of the layer thickness, wherein the control device is integrally mounted on a portion of the road finisher.

6. The finisher according to claim 5, wherein the control device is configured to adjust, based on the actual leveling value, a position of leveling cylinders attached to the paving screed at front traction points for varying the layer thickness.

7. The road finisher according to claim 1, wherein the measuring device comprises a supporting structure for the first and second sensor units extending along the paving direction, on which supporting structure the first sensor unit is positioned in front of the paving screed and the second sensor unit is positioned behind the paving screed in the paving direction.

8. The road finisher according to claim 1, wherein the measuring device comprises a third sensor unit and a fourth sensor unit for measuring respective distances to the surface of the subgrade, the third and fourth sensor units being positioned in the paving direction in front of the paving screed on the supporting structure, and wherein the first, second, third and fourth sensor units are positioned in the paving direction at a multiple of a predetermined distance from one another on the supporting structure of the measuring device.

9. The road finisher according to claim 1 further comprising at least one distance measuring means, wherein the at least one distance measuring means includes a satellite-based distance measuring unit and a mechanical distance measuring unit, or the at least one distance measuring means includes at least one optical distance measuring unit.

10. The road finisher according to claim 1, wherein the sensor units each comprise an ultrasonic multi-sensor having a plurality of sensor cells arranged side by side, each configured to perform distance measurements.

11. The road finisher according to claim 10, wherein the road finisher is configured to take into account the distance measurements detected by the sensor units by means of the respective sensor cells formed on the sensor units, the distance measurements being tolerant with respect to a nominal distance measurement value which is variably adjustable for the respective sensor units, when leveling the paving screed and/or when determining the layer thickness.

12. The road finisher according to claim 1, wherein a currently determined layer thickness or a layer thickness averaged over a period of time therefrom can be provided to the leveling system for controlling the height of the paving screed as a further leveling actual value.

13. The finisher according to claim 1, wherein the leveling system comprises a second measuring device, the first measuring device being arranged in the paving direction on one side of the road finisher and the second measuring device being arranged in the paving direction on an opposite side of the road finisher.

14. The road finisher according to claim 1, wherein the leveling system is functionally connected to a memory unit, on which, for documentation purposes, measured layer thickness values detected during the paving run can be stored and/or the detected layer thickness can be displayed visually at an external operating stand of the road finisher by means of a display unit attached thereto and/or the road finisher has a transmission unit by means of which the determined layer thickness values can be transmitted to an external device.

* * * * *